US012655746B2

(12) United States Patent
Skinner et al.

(10) Patent No.: US 12,655,746 B2
(45) Date of Patent: Jun. 16, 2026

(54) DOWNHOLE TEMPERATURE SENSOR CORRECTION SYSTEM

(71) Applicant: Baker Hughes Oilfield Operations LLC, Houston, TX (US)

(72) Inventors: Alexander Skinner, Inverurie (GB); Gary Andrews, Inverurie (GB)

(73) Assignee: Baker Hughes Oilfield Operations LLC, Houston, TX (US)

( * ) Notice: Subject to any disclaimer, the term of this patent is extended or adjusted under 35 U.S.C. 154(b) by 271 days.

(21) Appl. No.: 18/227,203

(22) Filed: Jul. 27, 2023

(65) Prior Publication Data

US 2025/0034985 A1 Jan. 30, 2025

(51) Int. Cl.
*E21B 47/008* (2012.01)
*E21B 47/07* (2012.01)

(52) U.S. Cl.
CPC ..... *E21B 47/008* (2020.05); *E21B 47/07* (2020.05)

(58) Field of Classification Search
CPC ..... E21B 47/008; E21B 47/07; E21B 43/128
See application file for complete search history.

(56) References Cited

U.S. PATENT DOCUMENTS 4,161,678 A * 7/1979 Kaieda ..... G05D 3/1418 318/641
4,427,941 A 1/1984 Riedesel et al.
2010/0047089 A1* 2/2010 Booker ..... G01K 13/08 374/E7.004
2010/0246630 A1 9/2010 Kaszynski et al.
2018/0195373 A1 7/2018 Bell et al.

FOREIGN PATENT DOCUMENTS

KR 20210150128 A 12/2021

OTHER PUBLICATIONS

International Search Report and Written Opinion for PCT/US2024/040050 mailed Oct. 30, 2024.

* cited by examiner

*Primary Examiner* — Xin Y Zhong
(74) *Attorney, Agent, or Firm* — Baker Hughes Company

(57) ABSTRACT

A method for measuring the temperature of a submersible pumping system motor includes the steps of obtaining an analog motor temperature signal from a motor temperature sensor, converting the analog motor temperature signal to a digital motor temperature signal using an analog-to-digital converter (ADC), providing the digital motor temperature signal to a processor, determining the absolute value of the digital motor temperature signal with the processor to produce a corrected digital motor temperature signal, and reporting the corrected digital motor temperature signal. The method is designed to correct the measurements made by the motor temperature sensor in the event the motor temperature sensor is connected incorrectly.

17 Claims, 5 Drawing Sheets

DOWNHOLE TEMPERATURE SENSOR CORRECTION SYSTEM

FIELD OF THE INVENTION

This invention relates generally to the field of submersible pumping systems, and more particularly, but not by way of limitation, to a system and method for determining and correcting downhole temperature measurements.

BACKGROUND

Submersible pumping systems are often deployed into wells to recover petroleum fluids from subterranean reservoirs. Typically, a submersible pumping system includes a number of components, including an electric motor coupled to one or more high performance pump assemblies. Production tubing is connected to the pump assemblies to deliver the petroleum fluids from the subterranean reservoir to a storage facility on the surface.

The motor is typically an oil-filled, high capacity electric motor that can vary in length from a few feet to nearly one hundred feet, and may be rated up to hundreds of horsepower. Typically, electricity is generated on the surface and supplied to the motor through a heavy-duty power cable. The power cable typically includes several separate conductors that are individually insulated within the power cable.

It is important to monitor the temperature of the motor during operation of the downhole pumping system. Thermocouples and resistance temperature detectors (RTDs) have been used as temperature sensors to measure the temperature of the motor by placing the sensor in close proximity to the windings of the motor. The leads from the temperature sensor are typically connected in the field to a downhole sensor module (or gauge) attached to the motor. The sensor module collects the output from the temperature sensor and reports the temperature reading to the operator on the surface.

Through installer error, the leads from the temperature sensor can be incorrectly connected to the sensor module. It can be difficult to visually identify the polarity of the leads and the corresponding connectors in the sensor module, particularly in remote environments with poor lighting. If the leads from the temperature sensor are unintentionally reversed when they are connected to the sensor module, the output signal generated by the temperature sensor can be reversed or altogether absent. In certain cases, the erroneous temperature measurements cause the operator to pull the pumping system to investigate and correct the faulty connection between the temperate sensor and the sensor module.

There is, therefore, a need for an improved temperature sensor system that identifies and corrects improperly connected temperature sensors and determines if the temperature sensor is no longer operational. The present disclosure is directed to these and other deficiencies in the prior art.

SUMMARY OF THE INVENTION

In one aspect, embodiments of the present disclosure are directed to a method for measuring the temperature of a motor used in a submersible pumping system. In these embodiments, the method includes the steps of obtaining an analog motor temperature signal from a motor temperature sensor, converting the analog motor temperature signal to a digital motor temperature signal using an analog-to-digital converter (ADC), providing the digital motor temperature signal to a processor, determining the absolute value of the digital motor temperature signal with the processor to produce a corrected digital motor temperature signal, and reporting the corrected digital motor temperature signal.

In other aspects, the present disclosure is directed to a method for measuring the temperature of a motor used in a submersible pumping system where the method includes the steps of connecting a motor temperature sensor to a temperature sensor circuit in a sensor module, connecting the sensor module to the motor, deploying the pumping system into a wellbore, energizing the motor with a motor drive, obtaining an analog motor temperature signal from the motor temperature sensor, converting the analog motor temperature signal to a digital motor temperature signal using an analog-to-digital converter (ADC) within the temperature sensor circuit, providing the digital motor temperature signal to a processor within the temperature sensor circuit, determining the absolute value of the digital motor temperature signal with the processor to produce a corrected digital motor temperature signal, and reporting the corrected digital motor temperature signal to the motor drive.

In yet other embodiments, the present disclosure is directed to method for measuring the temperature of a motor within a submersible pumping system. In these embodiments, the method begins with the step of performing a sensor test using a motor temperature sensor circuit. If the motor temperature sensor is detected, the method continues with the step of determining the type of the motor temperature sensor and then measuring the temperature of the motor with the motor temperature sensor. If, on the other hand, a motor temperature sensor is not detected, the method continues with the step of measuring the temperature of the motor with a cold junction temperature reference within the motor temperature sensor circuit.

DETAILED DESCRIPTION

Figure 1:
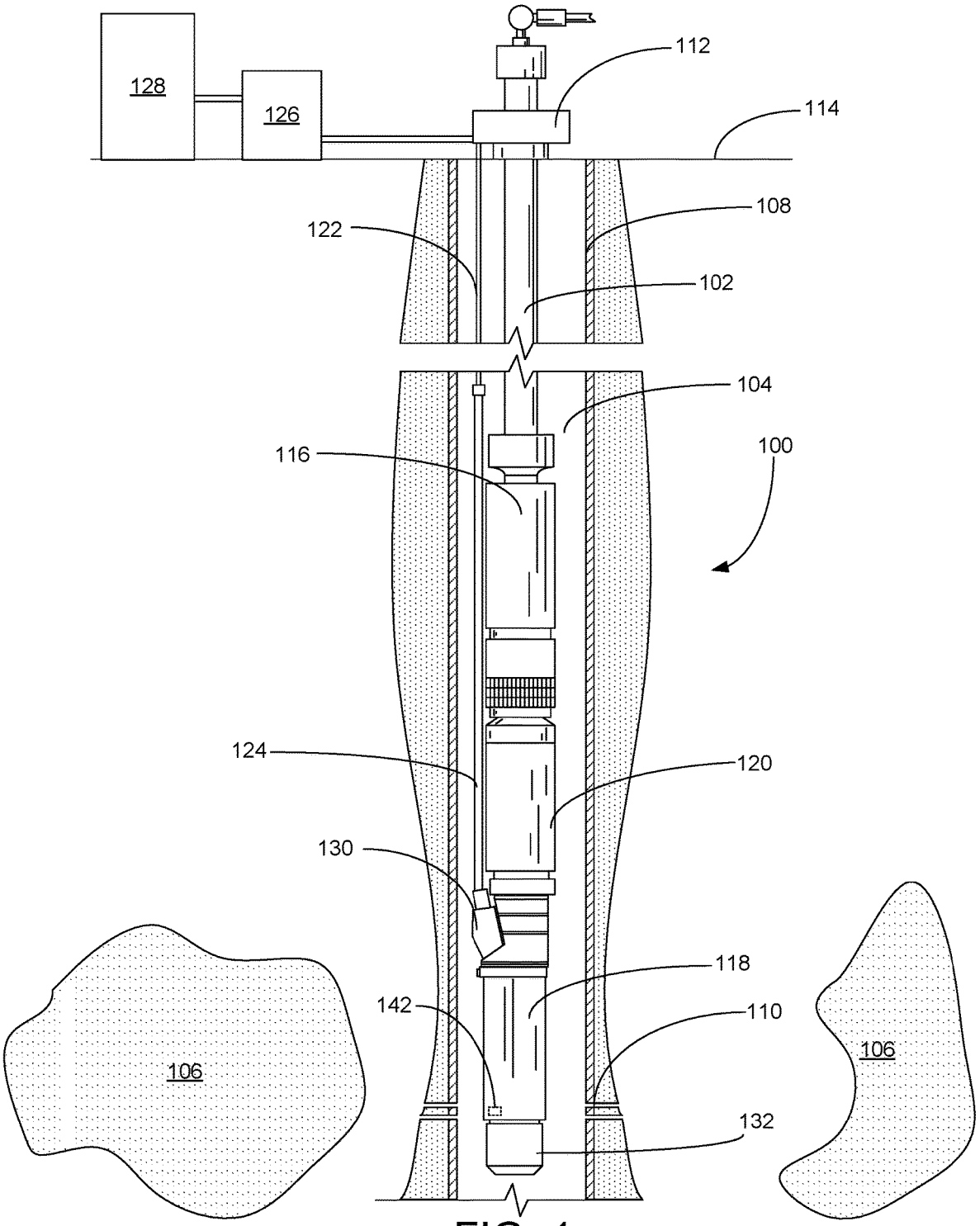
FIG. 1 is an elevational depiction of an electric submersible pumping system.

In accordance with an exemplary embodiment of the present invention, FIG. 1 shows a front view of a downhole pumping system 100 attached to production tubing 102. The downhole pumping system 100 and production tubing 102 are disposed in a wellbore 104, which is drilled for the production of a fluid such as water or petroleum from a subterranean geologic formation 106.

The wellbore 104 includes a casing 108, which has perforations 110 that permit the exchange of fluids between the wellbore 104 and the geologic formation 106. Although the downhole pumping system 100 is depicted in a vertical well, it will be appreciated that the downhole pumping system 100 can also be used in horizontal, deviated, and other non-vertical wells. Accordingly, the terms "upper" and "lower" should not be construed as limiting the disclosed embodiments to use in vertical wells.

The production tubing 102 connects the pumping system 100 to a wellhead 112 located on the surface 114, which may be onshore or offshore. Although the pumping system 100 is primarily designed to pump petroleum products, it will be understood that the present invention can also be used to move other fluids.

The pumping system 100 includes a pump 116, a motor 118 and a seal section 120. The motor 118 is an electric motor that receives its power from a surface-based supply through a power cable 122 and one or more motor lead extensions 124. In many embodiments, the power cable 122 and motor lead extension 124 are configured to supply the motor 118 with three-phase electricity from a surface-based variable speed (or variable frequency) motor drive 126, which receives electricity from a power source 128. The electricity is carried along separate conductors (not separately designated), which each correspond to a separate phase of the electricity. The motor lead extension 124 connects to the motor 118 through a connector 130, which is often referred to as a "pothead" connector. The motor lead extension 124 extends into the pothead 130, where it terminates in a connection to the conductor leads of the motor 118. The pothead connector 130 relieves mechanical stresses between the motor lead extension 124 and the motor 118, while providing a sealed connection that prevents the ingress of wellbore fluids into the motor 118, motor lead extension 124, or pothead 130.

The motor 118 converts the electrical energy into mechanical energy, which is transmitted to the pump 116 by one or more shafts. The pump 116 then transfers a portion of this mechanical energy to fluids within the wellbore 104, causing the wellbore fluids to move through the production tubing 102 to the surface 114. In some embodiments, the pump 116 is a turbomachine that uses one or more impellers and diffusers to convert mechanical energy into pressure head. In other embodiments, the pump 116 is a progressive cavity (PC) or positive displacement pump that moves wellbore fluids with one or more screws or pistons.

The seal section 120 shields the motor 118 from mechanical thrust produced by the pump 116. The seal section 120 is also configured to prevent the introduction of contaminants from the wellbore 104 into the motor 118, while also accommodating the thermal expansion and contraction of lubricants within the motor 118. Although only one pump 116, seal section 120 and motor 118 are shown, it will be understood that the downhole pumping system 100 could include additional pumps 116, seal sections 120 or motors 118.

The pumping system 100 also includes a gauge or sensor module 132 connected to the motor 118. As depicted in FIG. 1, the motor 118 is positioned between the sensor module 132 and the seal section 120. In other embodiments, the sensor module 132 can be located elsewhere in the pumping system 100, for example, between the motor 118 and the seal section 120. The sensor module 132 includes internal sensors and circuits for receiving and processing signals from remote sensors configured to measure operational and environmental conditions at the pumping system 100, as well as communications circuits for transmitting and receiving data from equipment located on the surface 114 or elsewhere in the wellbore 104.

Figure 2:
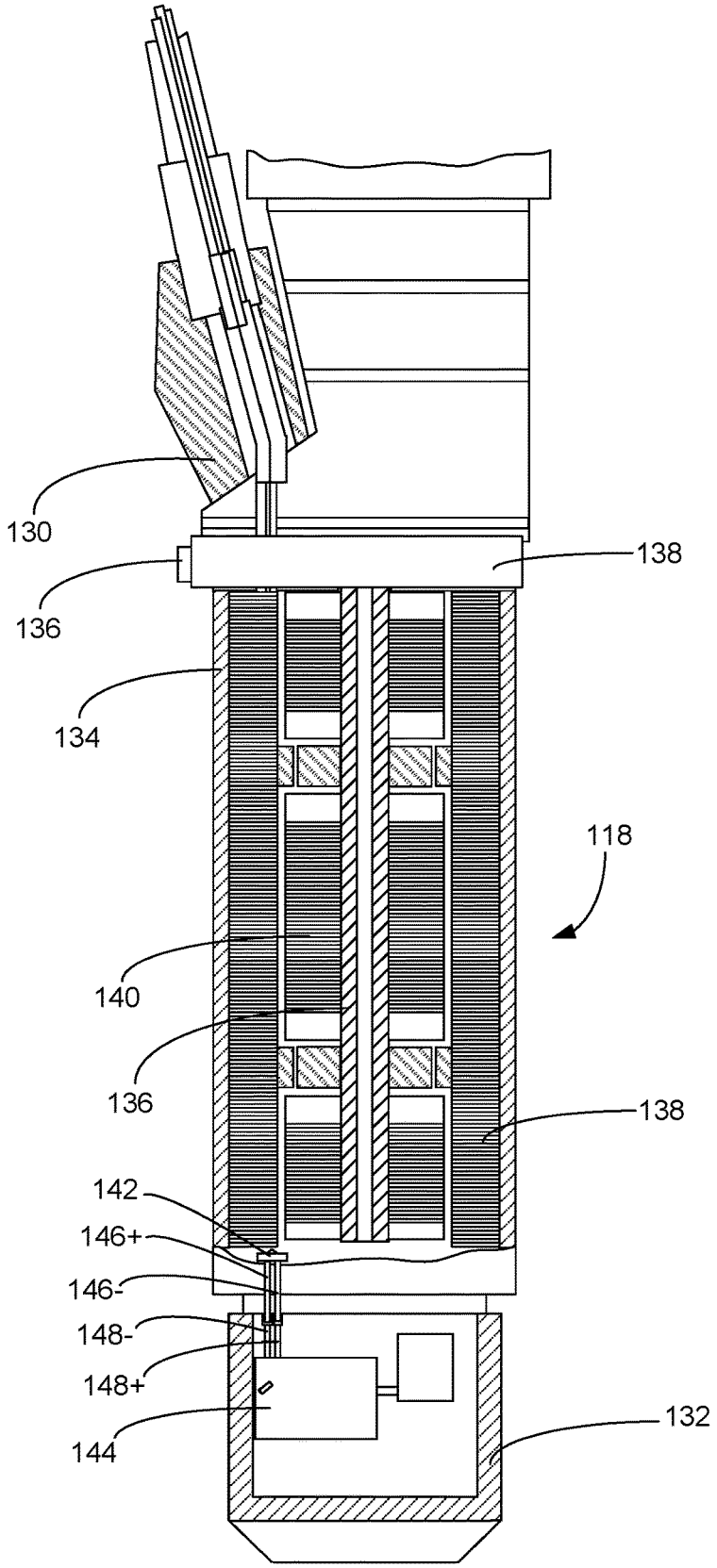
FIG. 2 is a cross-sectional depiction of the motor and sensor module of the electric submersible pump of FIG. 1.

As illustrated in FIG. 2, the motor 118 includes a motor housing 134, a shaft 136, a stator assembly 138, and a rotor 140. The stator assembly 138 is located adjacent the interior surface of the motor housing 134 and remains fixed relative the motor housing 134. The stator assembly 138 includes a stator core that is formed by passing magnet wire through slots in a plurality of stacked and compressed laminates to form windings or coils.

The motor 118 includes a motor temperature sensor 142. In exemplary embodiments, the motor temperature sensor 142 is configured to measure the internal temperature of the motor 118 and can be attached to the stator assembly 138 or positioned elsewhere in the motor 118 in a position where it can remain immersed in the motor fluid. In some embodiments, the motor temperature sensor 142 is a thermocouple that detects the temperature of the motor lubricating oil or stator windings in the motor 118. In other embodiments, the motor temperature sensor 142 is a resistance temperature detector (RTD), such as a platinum resistance temperature detector. In some embodiments, the motor 118 includes multiple motor temperature sensors 142 and multiple types of motor temperature sensors.

The motor temperature sensor 142 is configured to output a signal representative of the internal operating temperature of the motor 118 to a processing board 144 within the sensor module 132. The motor temperature sensor 142 includes positive and negative sensor leads 146+, 146− that extend through the motor housing 134, where they are connected to corresponding positive and negative sensor module leads 148+, 148−. In FIG. 2, the negative sensor lead 146− has been accidentally connected to the positive sensor module lead 148+. In prior art systems, the unintended reversal of the polarity of the sensor leads 146+, 146− and the sensor module leads 148+, 148− would cause erroneous or faulty readings based on the output of the motor temperature sensor.

Figure 3:
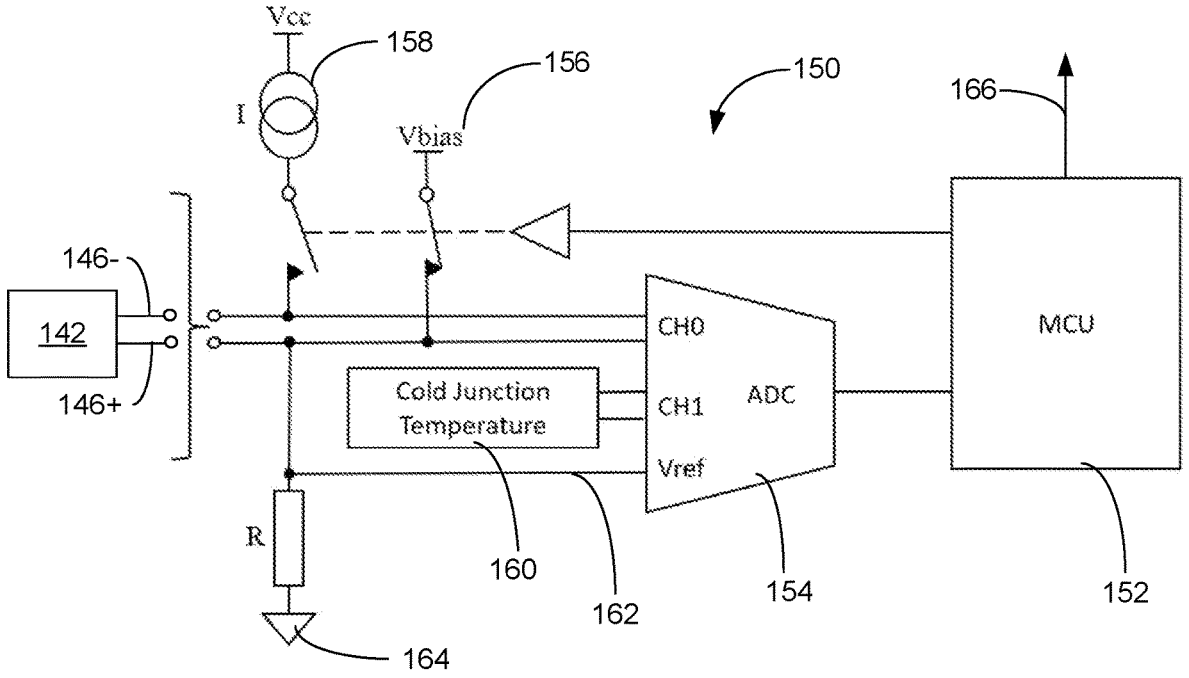
FIG. 3 depicts an exemplary circuit diagram for the temperature sensor and sensor module.

Turning to FIG. 3, shown therein is a temperature sensor circuit 150 for measuring and correcting the signals produced by the motor temperature sensor 142. In some embodiments, the temperature sensor circuit 150 is located in the sensor module 132 and incorporated within the processing board 144. In other embodiments, some or all of the temperature sensor circuit 150 is located inside the motor 118. The temperature sensor circuit 150 includes a processor 152, an analog-to-digital converter (ADC) 154, a bias voltage source 156 and a current source 158. In accordance with conventional thermocouple circuitry, the ADC 154 receives a signal from a cold junction temperature reference 160 and a signal along a reference voltage 162 line connected between the negative sensor module lead 148− and ground 164. The ADC 154 receives the measurement signal voltage on the sensor module leads 148+, 148− and, based on the signals from the cold junction temperature reference 160 and reference voltage line 162, converts those analog temperature signals to a digital temperature signal that is passed to the processor 152.

The processor 152 outputs a corrected digital temperature signal on output line 166, which can be connected to downstream processors or communication modules configured to report the corrected digital temperature signal to the motor drive 126 or other control and monitoring systems on the surface 114. In certain modes of operation, the processor 152 selectively activates the bias voltage source 156 and current source 158. It will be appreciated that the circuit depicted in FIG. 3 reflects a suitable embodiment for the temperature sensor circuit 150, but other circuits are also within the scope of acceptable embodiments of the temperature sensor circuit 150.

Figure 4:
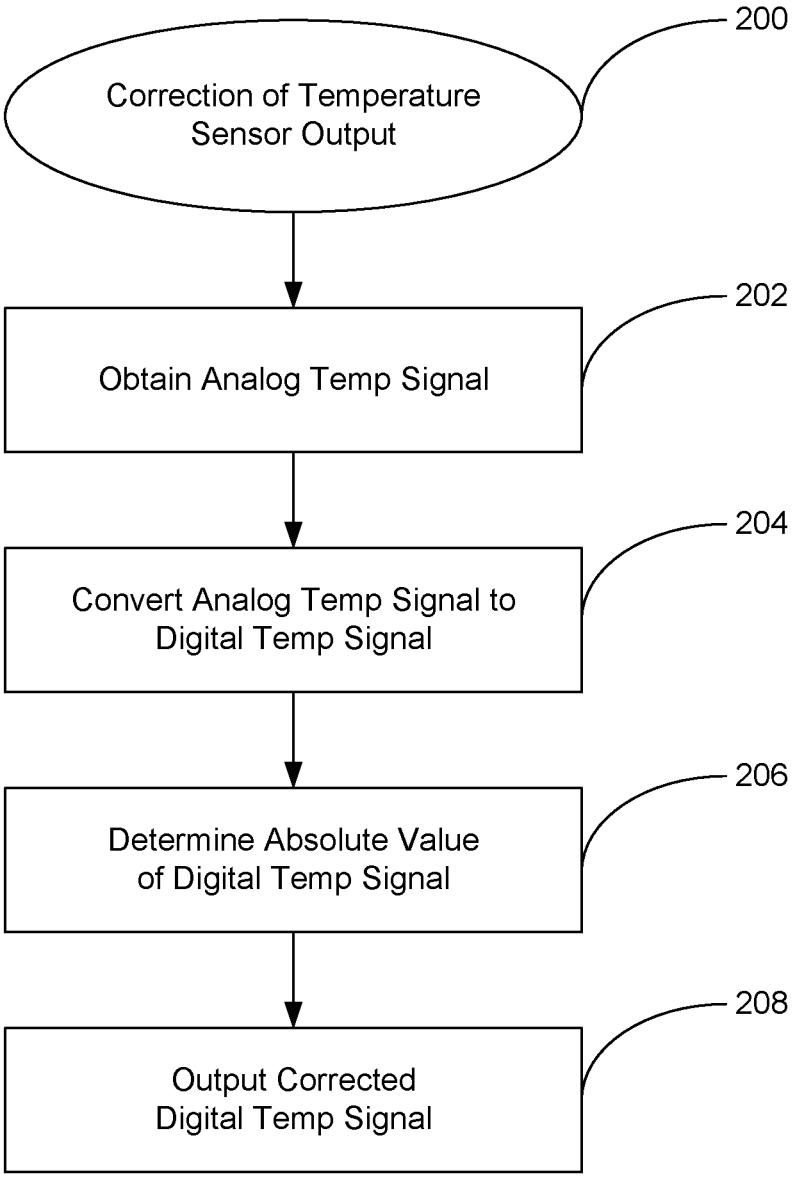
FIG. 4 is a process flow diagram illustrating a method of ensuring a correctly formatted output from the temperature sensor.

Turning to FIG. 4, shown therein is a process flow diagram for a temperature sensor correction method 200. The temperature sensor correction method 200 is optimally implemented as a signal processing routine within the processor 152, but it will be appreciated that the temperature sensor correction method 200 can also be implemented as a computer program in other downhole or surface-based systems, including the motor drive 126. The method 200 begins at step 202 when the analog voltage signals from the sensor leads 146+, 146– are passed to the sensor module leads 148+, 148–, which are then presented to the ADC 154. As indicated above, the sensor leads 146+, 146– can be misconnected to the corresponding sensor module leads 148+, 148–, which would produce an inverse of the analog motor temperature signal at the ADC 154. At step 204, the ADC 154 converts the analog motor temperature signal to a digital motor temperature signal, which is then passed to the processor 152.

At step 206, the processor 152 determines the absolute value of the digital motor temperature signal. In the digital domain, the determination of the absolute value of the digital temperature signal is a relatively straightforward calculation that can be accomplished through a variety of routines that are capable of being performed by the processor 152. The method 200 concludes at step 208 when the processor 152 outputs a corrected digital motor temperature signal along output line 166. In this way, the sensor module 132 is configured to report a corrected digital motor temperature signal that regardless of whether the sensor leads 146+, 146– and sensor module leads 148+, 148– were properly connected. This presents a significant advancement over prior systems that were unable to correct a mismatch in the polarity between the motor temperature sensor 142 and the sensor module 132. Although the method 200 is disclosed in connection with the correction of the output from the motor temperature sensor 142, it will be appreciated that the method 200 could also be applied to other analog sensors within the pumping system 100.

In addition to conveniently correcting the output from the motor temperature sensor 142, the processor 152 can also be configured to perform a sensor identification test 300. In some motors 118, the motor temperature sensor 142 is a thermocouple, while in other motors 118 the temperature sensor 142 is a resistance temperature detector (RTD). During the connection of the sensor module 132 to the motor 118, the installer may not be able to determine which sensor type is present from looking only at the sensor leads 146+, 146–. Once the sensor module 132 is connected and the pumping system 100 has been installed in the wellbore 104, it may be difficult to determine from the signals produced by the sensor module 132 if the motor temperature sensor 142 is faulty, disconnected or an unexpected type.

Figure 5:
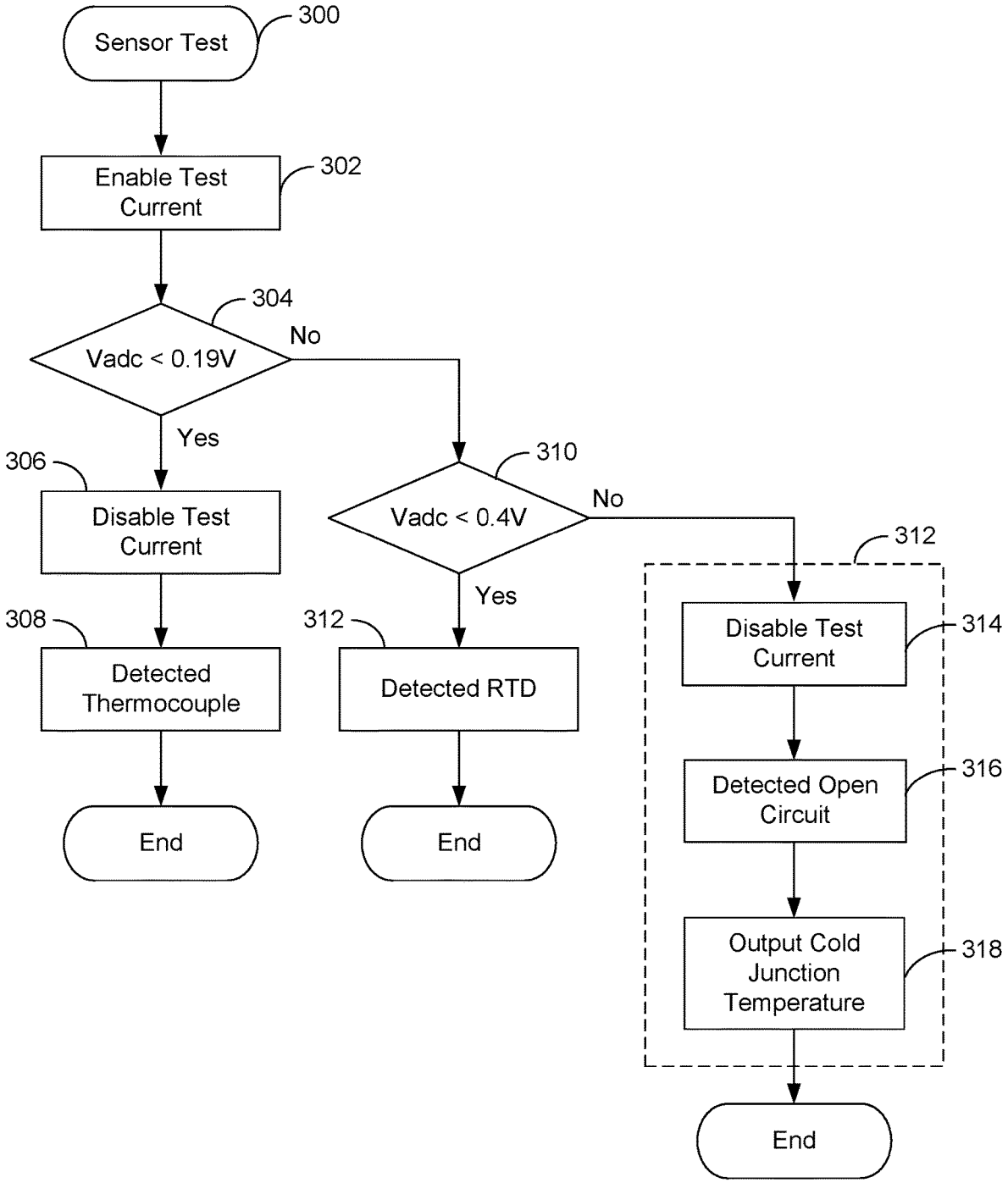
FIG. 5 is a process flow diagram illustrating a sensor test method of detecting the presence and operability of the temperature sensor.

Turning to FIG. 5, shown therein is a process flow diagram for a sensor test method 300 for determining the type and status of the motor temperature sensor 142. The method 300 begins at step 302 when the processor 152 applies a test current by activating the current source 158. At step 304, the processor 152 determines if the voltage at the ADC 154 (Vadc) is less than 0.19 volts. If the voltage at the ADC 154 is less than 0.19 volts, the method 300 moves to step 306 and the test current is disabled. At step 308, the processor 152 reports that the motor temperature sensor 142 is a thermocouple. The processor 152 can then adjust its operation to match the expected output from the thermocouple.

If the ADC voltage is greater than 0.19 volts at step 304, the method 300 moves to step 310, where the processor 152 determines if the ADC voltage (Vadc) is less than 0.4 volts. If the ADC voltage under the test current is less than 0.4 volts, the process moves to step 312 where the processor 152 identifies the motor temperature sensor 142 as a resistance temperature detector (RTD). The processor 152 can then adjust its operation to match the expected output from the resistance temperature detector.

If, however, the voltage at the ADC 154 is not less than 0.4 volts at step 310, the method 300 moves to a break condition process 312. In the break condition process 312, the processor 152 disables the test current at step 314 and reports that an open circuit exists at step 316. This condition could arise, for example, if the motor temperature sensor 142 is not connected to the temperature sensor circuit 150 or if the motor temperature sensor 142 is faulty. Once the processor 152 determines that a break condition exists, the method 300 moves to step 318 where the processor 152 pulls the signal from the cold junction temperature reference 160 as a proxy for the missing output from the motor temperature sensor 142. In some cases, the temperature from the cold junction temperature reference 160 can be interpreted and adjusted to provide a relatively close approximation of the internal motor temperature.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method for measuring the temperature of a motor within a submersible pumping system, the method comprising the steps of:

performing a sensor test using a motor temperature sensor circuit;

if a motor temperature sensor is detected, determining the type of the motor temperature sensor and measuring the temperature of the motor with the motor temperature sensor; and if a motor temperature sensor is not detected, measuring the temperature of the motor with a cold junction temperature reference within the motor temperature sensor circuit.

2. The method of claim 1, wherein the step of performing the sensor test comprises applying a test current from the motor temperature sensor circuit.

3. The method of claim 2, wherein the step of determining the type of the motor temperature sensor further comprises the step of determining that the motor temperature sensor is a thermocouple if a voltage measured at an analog-to-digital converter within the motor temperature sensor circuit is less than a first value.

4. The method of claim 2, wherein the step of determining the type of the motor temperature sensor further comprises the step of determining that the motor temperature sensor is a thermocouple if a voltage measured at an analog-to-digital converter within the motor temperature sensor circuit is less than about 0.2 volts.

5. The method of claim 2, wherein the step of determining the type of the motor temperature sensor further comprises the step of determining that the motor temperature sensor is a thermocouple if a voltage measured at an analog-to-digital converter within the motor temperature sensor circuit is less than 0.19 volts.

6. The method of claim 2, wherein the step of determining the type of the motor temperature sensor further comprises the step of determining that the motor temperature sensor is a resistance temperature detector (RTD) if a voltage measured at an analog-to-digital converter within the motor temperature sensor circuit is greater than a first value but less than a second value.

7. The method of claim 2, wherein the step of determining the type of the motor temperature sensor further comprises the step of determining that the motor temperature sensor is a resistance temperature detector (RTD) if a voltage measured at an analog-to-digital converter within the motor temperature sensor circuit is greater than about 0.2 volts but less than about 0.5 volts.

8. The method of claim 2, wherein the step of determining the type of the motor temperature sensor further comprises the step of determining that the motor temperature sensor is a resistance temperature detector (RTD) if a voltage measured at an analog-to-digital converter within the motor temperature sensor circuit is greater than about 0.19 volts but less than about 0.4 volts.

9. The method of claim 1, where the step of measuring the temperature of the motor with the motor temperature sensor further comprising the steps of:

obtaining an analog motor temperature signal from the motor temperature sensor;

converting the analog motor temperature signal to a digital motor temperature signal using an analog-to-digital converter (ADC);

providing the digital motor temperature signal to a processor;

determining the absolute value of the digital motor temperature signal with the processor to produce a corrected digital motor temperature signal; and reporting the corrected digital motor temperature signal.

10. A method for measuring the temperature of a motor within a submersible pumping system, the method comprising the steps of:

performing a sensor test using a motor temperature sensor circuit;

if a motor temperature sensor is detected, measuring the temperature of the motor with the motor temperature sensor; and if a motor temperature sensor is not detected, measuring the temperature of the motor with a cold junction temperature reference within the motor temperature sensor circuit.

11. The method of claim 10, further comprising the step of determining the type of the motor temperature sensor if a motor temperature sensor is detected.

12. The method of claim 11, wherein the step of performing the sensor test comprises applying a test current from the motor temperature sensor circuit.

13. The method of claim 11, wherein the step of determining the type of the motor temperature sensor further comprises the step of determining that the motor temperature sensor is a thermocouple if a voltage measured at an analog-to-digital converter within the motor temperature sensor circuit is less than a first value.

14. The method of claim 13, wherein the step of determining the type of the motor temperature sensor further comprises the step of determining that the motor temperature sensor is a thermocouple if a voltage measured at an analog-to-digital converter within the motor temperature sensor circuit is less than about 0.2 volts.

15. The method of claim 11, wherein the step of determining the type of the motor temperature sensor further comprises the step of determining that the motor temperature sensor is a resistance temperature detector (RTD) if a voltage measured at an analog-to-digital converter within the motor temperature sensor circuit is greater than a first value but less than a second value.

16. The method of claim 15, wherein the step of determining the type of the motor temperature sensor further comprises the step of determining that the motor temperature sensor is a resistance temperature detector (RTD) if a voltage measured at an analog-to-digital converter within the motor temperature sensor circuit is greater than about 0.2 volts but less than about 0.5 volts.

17. The method of claim 11, where the step of measuring the temperature of the motor with the motor temperature sensor further comprising the steps of:

obtaining an analog motor temperature signal from the motor temperature sensor;

converting the analog motor temperature signal to a digital motor temperature signal using an analog-to-digital converter (ADC);

providing the digital motor temperature signal to a processor;

determining the absolute value of the digital motor temperature signal with the processor to produce a corrected digital motor temperature signal; and reporting the corrected digital motor temperature signal.

* * * * *